US010077596B2

(12) United States Patent
Cooper et al.

(10) Patent No.: US 10,077,596 B2
(45) Date of Patent: Sep. 18, 2018

(54) SMOKE OR FIRE BARRIER

(71) Applicant: Cooper Fire Limited, Hampshire (GB)

(72) Inventors: Andrew P Cooper, Hampshire (GB); William Charles James, Hampshire (GB)

(73) Assignee: Coopers Fire Limited, Portsmouth (GB)

( * ) Notice: Subject to any disclaimer, the term of this patent is extended or adjusted under 35 U.S.C. 154(b) by 0 days.

(21) Appl. No.: 15/029,482

(22) PCT Filed: Oct. 13, 2014

(86) PCT No.: PCT/GB2014/053071

§ 371 (c)(1),
(2) Date: Apr. 14, 2016

(87) PCT Pub. No.: WO2015/055990

PCT Pub. Date: Apr. 23, 2015

(65) Prior Publication Data

US 2016/0265269 A1 Sep. 15, 2016

(30) Foreign Application Priority Data

Oct. 14, 2013 (GB) ..... 1318172.2

(51) Int. Cl.

| | |
|---|---|
| ***E06B 9/06*** | (2006.01) |
| ***E06B 5/16*** | (2006.01) |
| ***A62C 2/10*** | (2006.01) |
| ***A62C 2/24*** | (2006.01) |

(52) U.S. Cl.
CPC ..... *E06B 5/16* (2013.01); *A62C 2/10* (2013.01); *A62C 2/241* (2013.01)

(58) Field of Classification Search
CPC ..... E06B 5/16; A62C 2/10; A62C 2/241
USPC ..... 160/269, 40, 41, 209, 37
See application file for complete search history.

(56) References Cited

U.S. PATENT DOCUMENTS

| | | | | | |
|---|---|---|---|---|---|
| 848,853 | A * | 4/1907 | Reed | E06B 9/307 | 160/210 |
| 1,330,224 | A * | 2/1920 | Whitson | E06B 3/921 | 160/19 |
| 1,751,950 | A * | 3/1930 | Sacerdote | E06B 9/54 | 160/269 |

(Continued)

FOREIGN PATENT DOCUMENTS

| | | | |
|---|---|---|---|
| EP | 2143470 A1 * | 1/2010 | A62C 2/06 |
| EP | 2169173 | 3/2010 | |

(Continued)

*Primary Examiner* — Katherine W Mitchell
*Assistant Examiner* — Johnnie A Shablack
(74) *Attorney, Agent, or Firm* — Bay State IP, LLC

(57) ABSTRACT

The present invention relates to a smoke or fire barrier for closing an opening in a building, the barrier including:

a curtain for closing the opening;

means arrangeable at a head of the opening for deploying the curtain and for retracting the curtain;

guide means at sides of the opening for retaining edges of the curtain after deployment and for reducing flow of smoke past the edges of the curtain, the guide means including:

a pair of jaws for holding the edges of the deployed curtain, at least one of the jaws being movable towards the other and means for moving the or each movable jaw after deployment of the curtain.

9 Claims, 3 Drawing Sheets

(56) References Cited

U.S. PATENT DOCUMENTS 1,756,496 A * 4/1930 Warnick ..... E06B 9/54 160/25
2,820,516 A * 1/1958 Cookson, Jr. ..... E06B 9/58 160/209
3,027,937 A * 4/1962 Wilson ..... E06B 7/18 160/40
3,237,682 A * 3/1966 Davis ..... E06B 9/17 160/133
3,646,877 A * 3/1972 Ellis ..... A62C 2/16 160/1
3,687,185 A * 8/1972 Singer ..... A62C 2/10 160/1
3,796,249 A * 3/1974 McCabe ..... A62C 2/16 160/1
3,960,216 A * 6/1976 Isobe ..... A62C 2/10 160/1
3,977,456 A * 8/1976 McCabe ..... A62C 2/16 160/1
4,077,474 A * 3/1978 Hattori ..... A62C 2/10 160/1
4,690,195 A * 9/1987 Taylor ..... E06B 9/70 160/133
4,727,919 A * 3/1988 Kraeutler ..... E06B 9/0669 160/298
4,880,046 A * 11/1989 Gesy ..... E05F 15/668 160/194
5,025,847 A * 6/1991 Mueller ..... E06B 9/13 160/133
5,383,510 A * 1/1995 Allen ..... A62C 2/10 160/243
5,809,699 A * 9/1998 Joly ..... E06B 9/0692 160/1
5,848,631 A * 12/1998 DeGiovanni ..... E06B 9/581 160/133
7,000,668 B2 * 2/2006 Sears ..... E06B 9/13 160/2
7,299,848 B2 * 11/2007 Streib ..... E06B 9/17007 160/243
7,735,539 B2 * 6/2010 Nakamura ..... A62C 2/10 160/243
2015/0361703 A1 * 12/2015 McDonald ..... E06B 3/44 160/113
2015/0361714 A1 * 12/2015 Derode ..... E06B 5/125 160/3

FOREIGN PATENT DOCUMENTS

FR 2586355 A1 * 2/1987 ..... A62C 2/10
JP 2007111207 5/2007
WO 2011/131799 10/2011

* cited by examiner

SMOKE OR FIRE BARRIER

CROSS REFERENCE TO RELATED APPLICATION

This application is for entry into the U.S. National Phase under § 371 for International Application No. PCT/GB2014/053071 having an international filing date of Oct. 13, 2014, and from which priority is claimed under all applicable sections of Title 35 of the United States Code including, but not limited to, Sections 120, 363, and 365(c), and which in turn claims priority under 35 USC 119 to Great Britain Patent Application No. 1318172.2 filed on Oct. 14, 2013.

The present invention relates to a smoke or fire barrier.

Smoke or fire barriers are intended to contain smoke, fire or smoke and fire. In certain applications fire barriers are required. In others the fire barrier must also stop smoke. Whereas in others still, the lower temperature task of restricting smoke flow flowing throughout a building or other construction is adequate. Insofar as heat and smoke rises it may not be necessary for a smoke barrier to extend from a ceiling all the way to the floor. For instance at an atrium, a smoke curtain dropping from the ceilings around the atrium can be extracted at a higher level. However, where the barrier is a fire barrier, it must extend all the way to the floor. In addition, the barrier must prevent smoke and fire from passing around its edges.

Many fire curtains are provided on one or more rollers, which are used to hold the curtain when not in use, and from which the curtain can be unwound for use. Providing the curtain on a roller protects the curtain from damage during storage, and provides for ease of deployment. The speed of rotation of the roller can be controlled to control the descent of the curtain. However, the roller for the curtain and the mechanism for deploying and retracting the curtain add considerably to the overall weight of the barrier. Such barriers are provided with side guides, which trap the edges of the curtain on deployment and hold them in a fixed position so that they cannot be moved by a fire draft or the like.

In certain circumstances curtains which are pleated for storage are also used. These are generally lighter than curtains with rollers and thus can be used in situations where weight is an issue. As such curtains are stored in a pleated state, when they are deployed a slight pleat is retained in the curtain. As a result of this and the way such curtains are deployed, namely that they drop down on lines, conventional side guides, having in-turned lips to retain projections on the edges of the curtain, are not suitable. Such curtains are generally used in closed systems, where the curtain extends around an area, for example an atrium. In these systems there are no edges to the curtains.

However, in situations where such curtains do have edges, the pleats results in openings or gaps through which smoke can pass. In addition as the edges are not held in a fixed position, the whole curtain can be drawn towards a fire as a result of a fire draft, resulting in bowing of the curtain creating a space through which fire and smoke can travel.

The object of the present invention is to provide an improved smoke or fire barrier.

According to the invention there is provided a smoke or fire barrier for closing an opening in a building, the barrier including:

a curtain for closing the opening;

means arrangeable at a head of the opening for deploying the curtain and for retracting the curtain;

guide means at sides of the opening for retaining edges of the curtain after deployment and for reducing flow of smoke past the edges of the curtain, the guide means including:

a pair of jaws for holding the edges of the deployed curtain, at least one of the jaws being movable towards the other and means for moving the or each movable jaw after deployment of the curtain.

In use, when the curtain is in the retracted position, the jaws are spaced apart to allow passage of the edges of the curtain therebetween. On full deployment of the curtain the means for moving the jaws moves at least one of the jaws towards the other, retaining the curtain between the jaws. This prevents the curtain from being pulled out of the guide means, for example by a fire draft, and reduces flow of smoke around the edges of the curtain.

Preferably the jaws may be in the form of plates arranged parallel to each other.

In some embodiments one of the jaws may be fixed, with the other jaw being movable. In other embodiments both the jaws may be movable. Usually the jaws are linked together for movement. The links may enable translational movement of one or both jaws. Alternatively the jaws may be hinged together for pivotal movement of one with respect to the other.

Preferably the barrier may further include a switch connected to the means for moving the or each jaw to activate movement of the or each jaw to retain the curtain. Conveniently the switch may be provided at the bottom of the guide means such that when a lower end of the curtain contacts the switch, when the curtain has reached the full extent of its deployment, the switch is activated to move at least one jaw towards the other to close the jaws. Typically the base of the curtain will be provided with a bottom bar, which weighs the curtain for descent. Usually the switch will be activated by contact with the bottom bar.

Preferably the barrier further includes doors for covering the guide means when the curtain is fully withdrawn, to hide the guide means when not in use. Usually the doors will be pivotally connected to the guide means.

Preferably the doors may be connected to springs to urge the doors into an open position in which the doors are not covering the guide means. Additionally electromagnets may be connected to the doors and/or the guide means to hold the doors in a closed position, in which the door is covering the guide means. The electromagnets will be stronger than the springs to hold the doors in the closed position.

Conveniently the barrier may be adapted to deploy the curtain in response to an alarm signal. Where doors held by electromagnets are provided, the response to the alarm signal may include means for switching off the electromagnets. This will result in opening of the doors under the action of the springs.

The barrier may also include a switch for retraction of the curtain after use. The retraction switch may also be adapted to initially cause the means for moving the or each jaw to move at least one of the jaws away from the other, releasing the curtain. In addition the retraction switch may also be adapted to turn on the electromagnets. This will allow the doors to be held in the closed position. However, the doors remain open until closed by a user after the curtain has been withdrawn.

To help understanding of the invention, a specific embodiment thereof will now be described by way of example and with reference to the accompanying drawings, in which.

Figure 1:
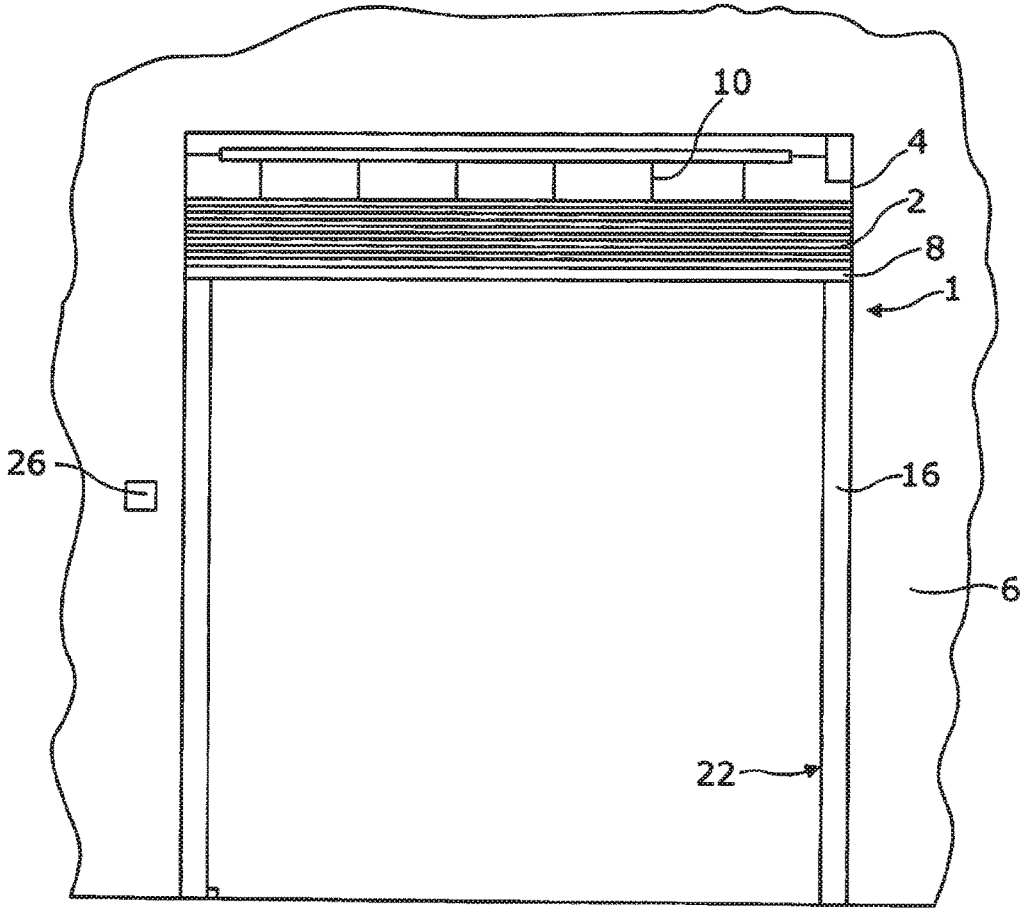
FIG. 1 is a front view of a smoke or fire barrier according to the invention.
Figure 2:
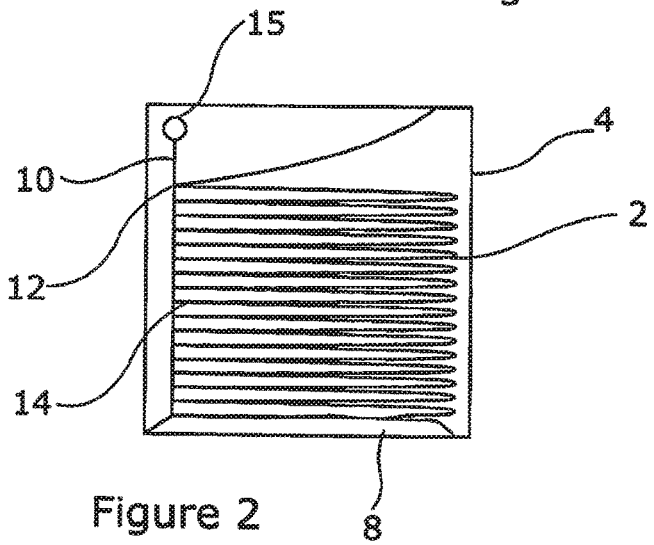
FIG. 2 is a cross-sectional view through the barrier of FIG. 1.
Figure 3:
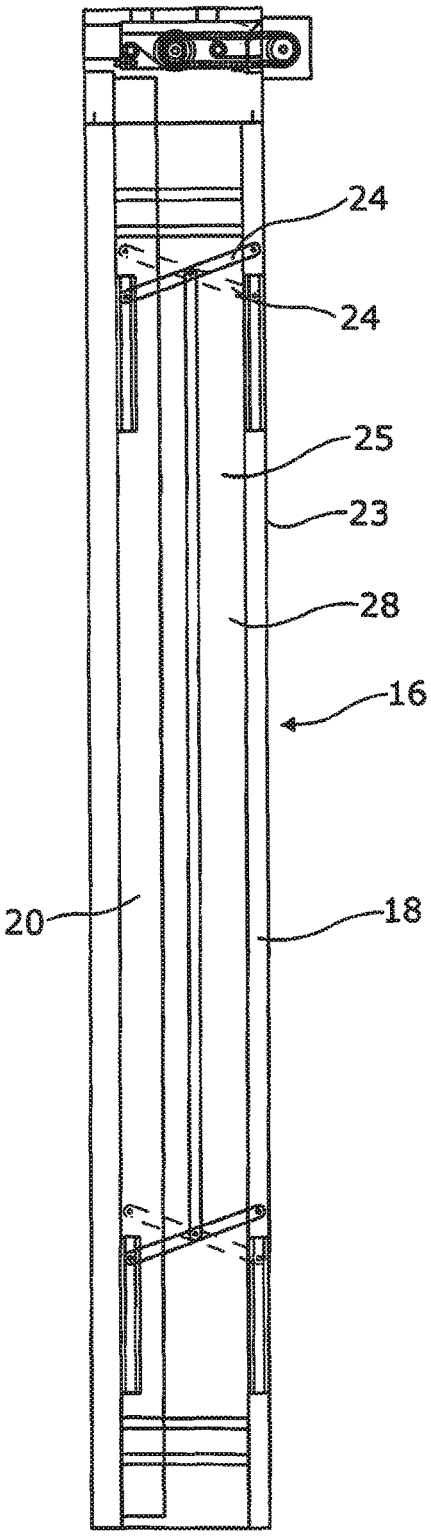
FIG. 3 is a front view of an edge channel according to the invention, with the edge plates open.
Figure 4:
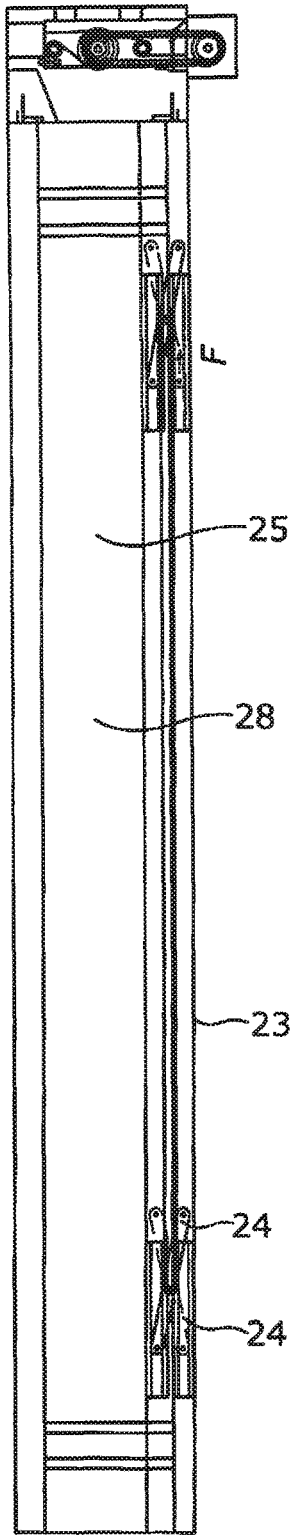
FIG. 4 is a front view of the edge channel of FIG. 3, with the edge plates closed.
Figure 5:
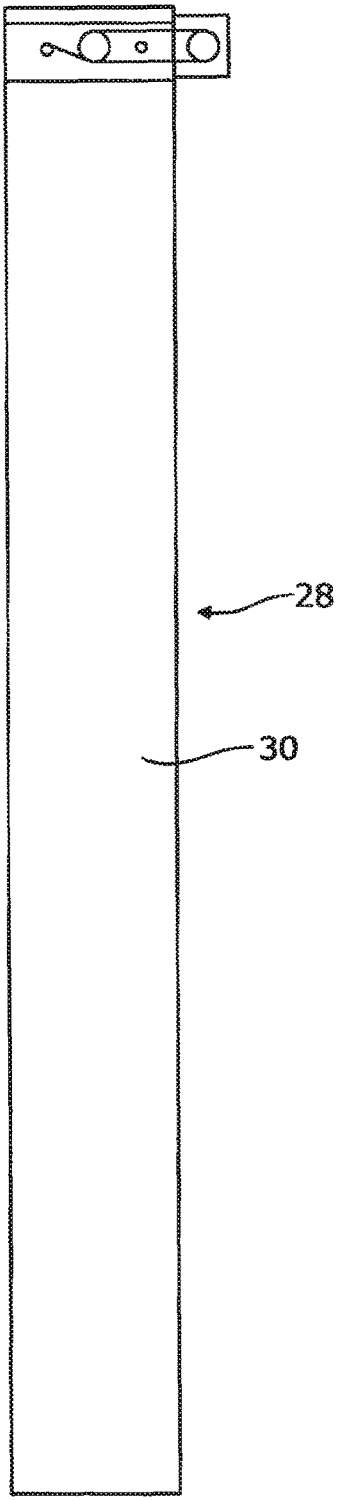
FIG. 5 is a front view of the edge channel having a door in the closed position.
Figure 6:
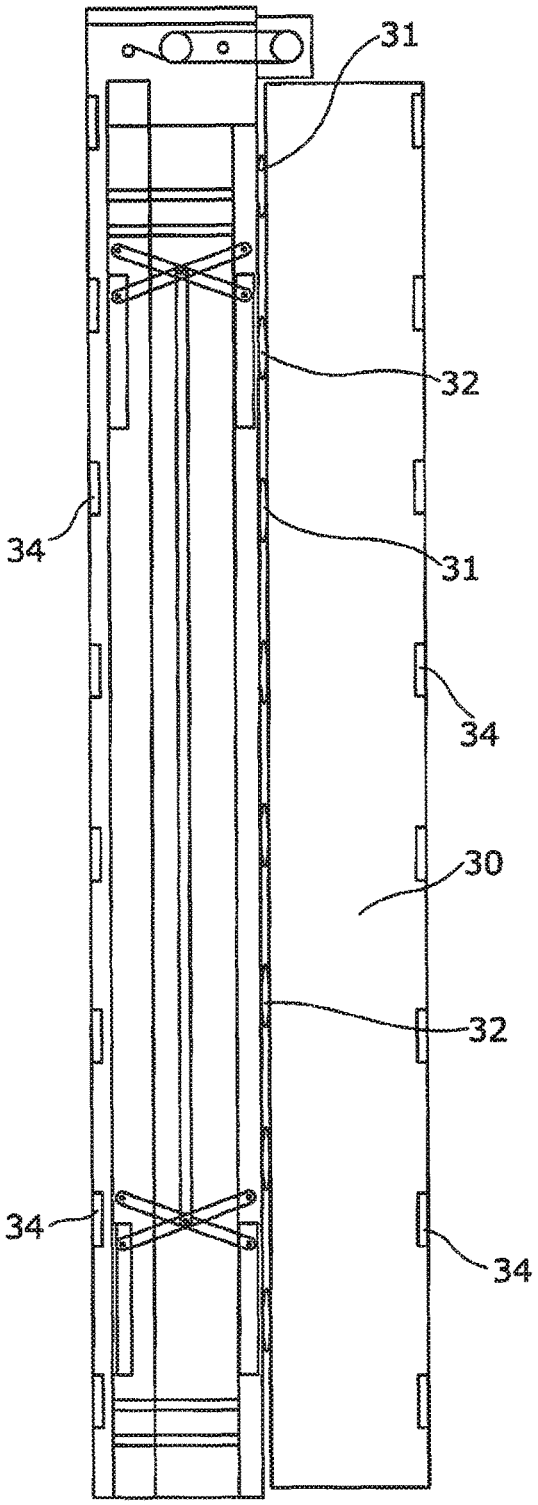
FIG. 6 is a front view of the edge channel of FIG. 5, with the door open.

Referring to the drawings, the smoke or fire barrier 1 comprises a curtain 2 contained in a headbox 4 mounted at the top of an opening 6 in a wall or the like in a building. The curtain is stored pleated. The curtain is also provided with a bottom bar 8, to weigh the curtain for descent. A number of wires 10 are provided attached to loops 12 at the ends of the pleats 14 and to the bottom bar 8. The wires are attached to spindles 15, which rotate under power to control the deployment and retraction of the curtain.

In accordance with the invention, along each edge 16 of the opening 6 is provided a side guide 17. As shown it is provided in a channel 22 in the edge of the opening, the channel having two sides 23 and a back 25. Alternatively the side guide 17 as such could be mounted on the edge 16 of the opening. The side guide 16 includes a pair of edge plates 18, 20 for clamping the curtain after deployment. The plates are long strips, typically of metal, in particular steel, although they could be of high temperature resistant plastics materials. The plates form the sides of an open channel 28 into which the edge of the curtain passes on deployment.

The edge plates are connected together at their inner edges by diagonal cross members 24. One of the edge plates 18 is secured to the channel 28, while the other one 20 is connected to the first via the cross-members 24. The movable plate 20 is connected to a motor, which when switched on urges the second plate into a position flat against the first plate. When the curtain is deployed this will clamp the curtain between the first and second plates, which will prevent removal of the curtain from the guide, for example as a result of a fire draft, and also prevent the passage of smoke around the edges of the curtain.

When the curtain is withdrawn and held in within the headbox, the channel is open, with the edge plates arranged on either side of the channel 28. On activation of an alarm condition, the curtain is deployed, with the edges of the bottom bar 8 and the curtain 2 passing down the channel. When the bottom bar reaches the floor, or bottom extent of its deployment, it triggers a switch, typically by depressing a plunger, which activates the motor to urge the movable plate 20 against the fixed plate 18, clamping the curtain therebetween. The edge plates close in the manner of a trellis, with the movable plate 20 moving across with respect to the fixed plate 18. However, other movement actions can be envisaged, for example the edge plate could slide directly across the channel on runners. This prevents, or significantly reduces, smoke from passing around the edge of the curtain.

To withdraw the curtain a user has to press a switch 26. This may be after a test or a false alarm. Pressing of the switch causes the motor to open the edge plates to release the curtain. It also causes the curtain motor to withdraw the curtain by rolling the wires on the spindles.

Conveniently, the channel 28 may be provided with a door 30, which can close the channel when the curtain is fully withdrawn, concealing the channel. The door 30 is hingedly 31 connected to the fixed plate 18 and when the curtain is fully withdrawn can be closed. The door is held in an open position by a spring 32, or a series of springs along the length of the door. However, the door can also be held closed by a series of electromagnets 34. These may be provided at intervals along the length of the door, or a single magnetic may be provided. The magnets are stronger than the spring, such that while the electromagnets are switched on the door remains closed. On activation of an alarm condition, power to the electromagnets is switched off, causing the door to open under action of the spring(s) 32. The curtain can then descend with its edge passing down the channel 28.

As discussed above, for withdrawal of the curtain, a user presses a withdrawal switch. In additional to opening the edge plates and withdrawing the curtain, this switch also turns the electromagnets back on. Once the curtain has been fully withdrawn the user can then manually close the door, which will be held in place by the electromagnets.

Thus, in the event of an alarm signal the power to the electromagnets 34 is switched off, which results in opening of the door, and opening the channel. The curtain can then descend. Usually this will be as a result of release of a brake, allowing the weight of the curtain and bottom bar to cause the curtain to fall. However, the descent may be powered. Once the curtain reached the bottom of the channel, it activates a switch which closes the edge plates 18, 20, clamping the edges of the curtain between them.

For withdrawal of the curtain, a user pressed a withdrawal switch, which initially opens the edge plates 18, 20. In addition, the curtain motor is activated with withdraw the curtain, but drawing the wires up onto the spindle. On full withdrawal of the curtain, the brake is then activated to hold the curtain in the withdrawn position. The power to the electromagnets 34 is also turned on. Once the curtain has been withdrawn, the door 30 over the channel 28 can be closed by a user, concealing the channel.

The invention is not intended to be restricted to the details of the above-described embodiment. For instance, while the side plates are described with reference to a pleated or concertina curtain, they could also be used with a curtain provided on a roller, or in any other way. In a further alternative, the jaws are not plates but at least one edge which clamps the curtain either against the side of a channel forming the side guide, or two edges clamping the curtain therebetween. In some embodiments the jaws may be provided with soft flexible edges for improved contact with the jaw and the curtain to further minimise smoke passing around the edge of the curtain.

The invention claimed is:

1. A smoke or fire barrier for closing an opening in a building, the barrier including:

a pleated or concertina curtain for closing the opening;

means arrangeable at a head of the opening for deploying the curtain and for retracting the curtain;

guide means at sides of the opening for retaining pleated or concertina edges of the curtain after deployment and for reducing flow of smoke past the pleated or concertina edges of the curtain, the guide means including:

a pair of jaws for holding the pleated or concertina edges of the deployed curtain, at least one of the jaws being movable towards the other;

the pair of jaws being spaced apart before deployment to allow passage of the pleated or concertina edges of the curtain therebetween, and means for moving the or each movable jaw after deployment of the curtain, the pair of jaws adapted to close openings or gaps created by a pleated or concertina edge through which smoke can pass doors for covering the guide means when not in use, and to be urged open when in use; and wherein the door is held in an open position with the provision of at least one spring and a closed position with the provision of at least one electromagnet, the electromagnet force being stronger than the spring bias to hold the doors in the closed position.

2. The smoke or fire barrier as claimed in claim 1, wherein the jaws are plates arranged parallel to each other.

3. The smoke or fire barrier as claimed in claim 1, wherein the jaws of the pair are movable towards each other.

4. The smoke or fire barrier as claimed in claim 1, wherein the jaws are linked together to provide translational movement of one or both jaws or are hinged together to provide pivotal movement of one jaw or both jaws with respect to the other.

5. The smoke or fire barrier as claimed in claim 1, further comprising a switch connected to the means for moving the or each jaw to activate movement of the or each jaw to retain the curtain.

6. The smoke or fire barrier as claimed in claim 5, wherein the switch is provided at the bottom of the guide means.

7. The smoke or fire barrier as claimed in claim 1, wherein the doors are pivotally connected to the guide means.

8. The smoke or fire barrier as claimed in claim 1, further comprising a retraction switch adapted to cause the means for moving the or each jaw to move at least one of the jaws away from the other, releasing the curtain.

9. The smoke or fire barrier as claimed in claim 1, further comprising a retraction switch adapted to switch on the electromagnets.

* * * * *